US007278764B2

(12) United States Patent
Kim

(10) Patent No.: US 7,278,764 B2
(45) Date of Patent: Oct. 9, 2007

(54) OBJECT-ATTACHING CLIP

(75) Inventor: Paul Y. Kim, Santa Ana, CA (US)

(73) Assignee: Surefire, LLC, Fountain Valley, CA (US)

( * ) Notice: Subject to any disclaimer, the term of this patent is extended or adjusted under 35 U.S.C. 154(b) by 212 days.

(21) Appl. No.: 11/031,756

(22) Filed: Jan. 6, 2005

(65) Prior Publication Data

US 2006/0146545 A1 Jul. 6, 2006

(51) Int. Cl.
*F21V 21/088* (2006.01)

(52) U.S. Cl. ..... 362/382; 362/191; 362/206; 362/396; 362/103

(58) Field of Classification Search ..... 362/382, 362/190, 191, 206, 396, 103, 108; 248/230.1, 248/230.7, 67.5, 73, 74.2, 316.7
See application file for complete search history.

(56) References Cited

U.S. PATENT DOCUMENTS 1,279,186 A 9/1918 Wahl
1,330,974 A * 2/1920 Bauman et al. ..... 362/184
1,520,839 A * 12/1924 Muhlhausen ..... 362/191
2,134,856 A 11/1938 Burgess
2,385,640 A 9/1945 Packer et al.
2,470,421 A 5/1949 Woody
3,711,703 A 1/1973 Bacevius
4,484,253 A 11/1984 Roberts
4,495,551 A 1/1985 Foltz
4,517,628 A 5/1985 McDermott
4,563,728 A 1/1986 Bruggeman et al.
5,025,966 A 6/1991 Potter
5,050,053 A * 9/1991 McDermott ..... 362/204
5,144,546 A 9/1992 Burdi
5,570,965 A 11/1996 Coolen
5,630,535 A 5/1997 Valenti
5,642,932 A 7/1997 Matthews
5,660,363 A 8/1997 Maglica
5,816,684 A 10/1998 Yu
6,547,415 B1 4/2003 Matthews
6,712,485 B2 3/2004 Matthews

* cited by examiner

*Primary Examiner*—Sharon Payne

(57) ABSTRACT

A clip enables an object, such as a flashlight, to be held onto a support, such as a belt. The object body, such as a flashlight barrel, has an extended surface along which an elongated portion of the clip extends. A body-holding portion holds the clip to the body and defines an object-to-support holding site. The clip comprises a resilient wire having arcuate prongs secured within arcuate grooves in the flashlight barrel by an annular retainer.

37 Claims, 4 Drawing Sheets

Fig. 1.
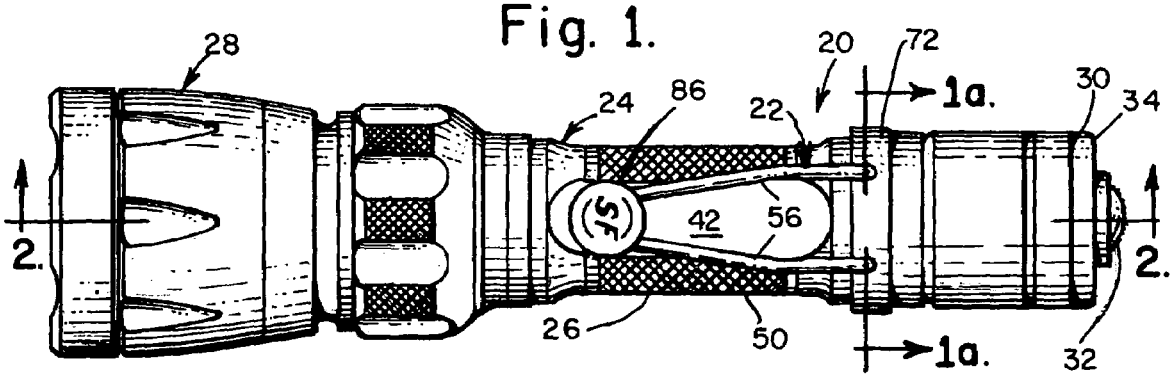
Fig. 1a.
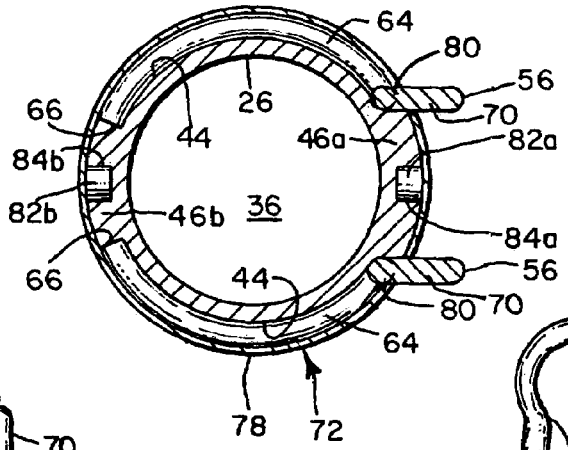
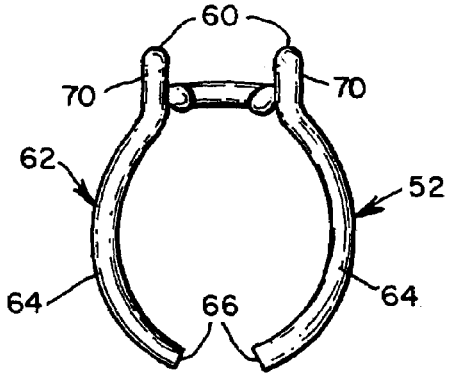
Fig. 4.
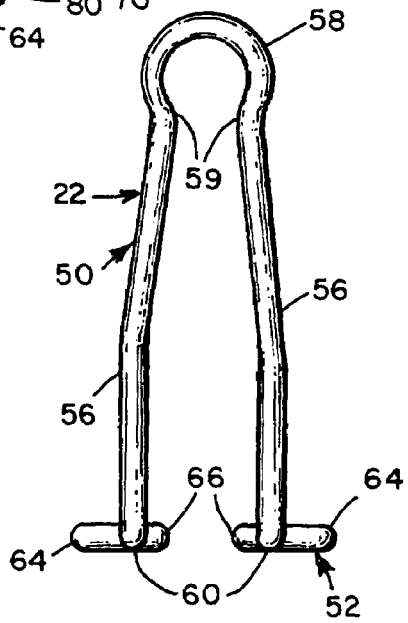
Fig. 3.

Fig. 11
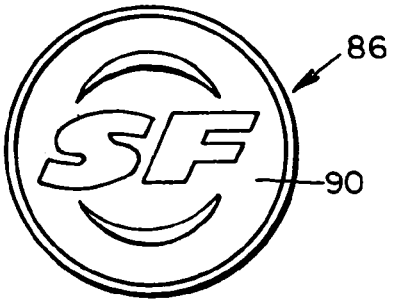
Fig. 12.
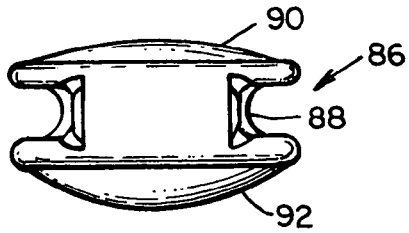
Fig. 13.
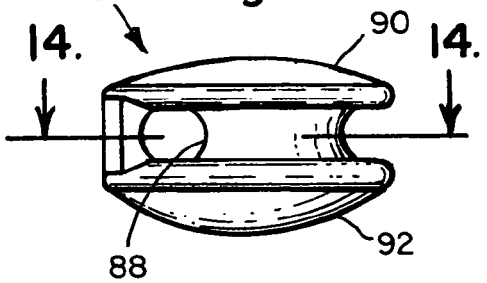
Fig. 14.
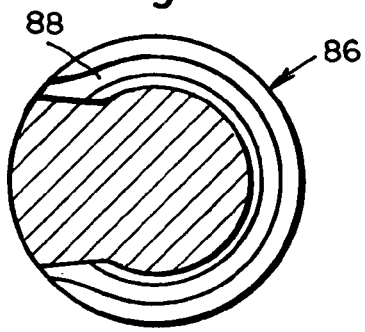
Fig. 1b.
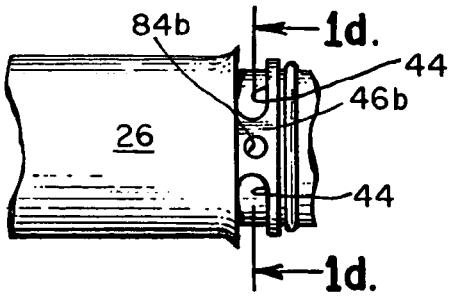
Fig. 1d.
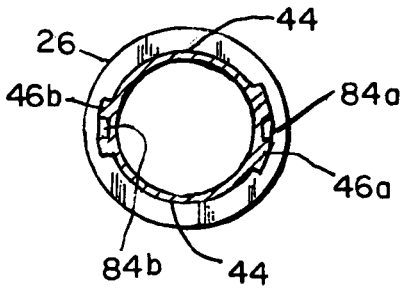
Fig. 1c.
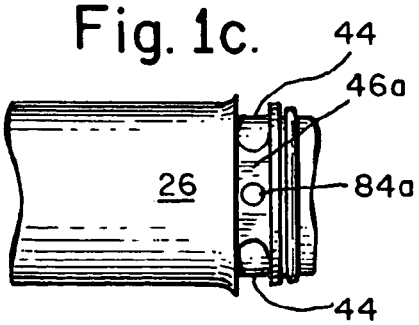
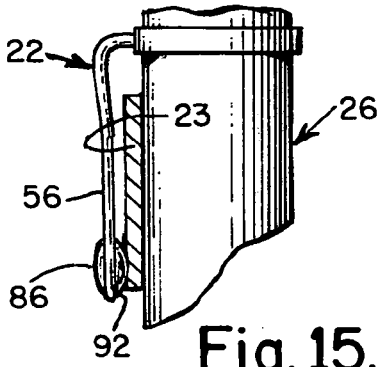
Fig. 15.

Fig. 5.
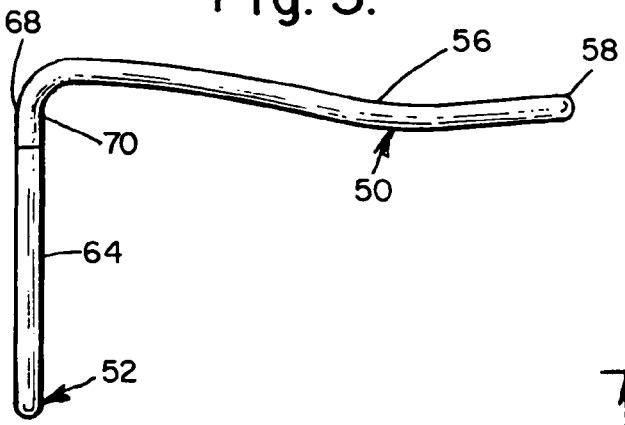
Fig. 6.
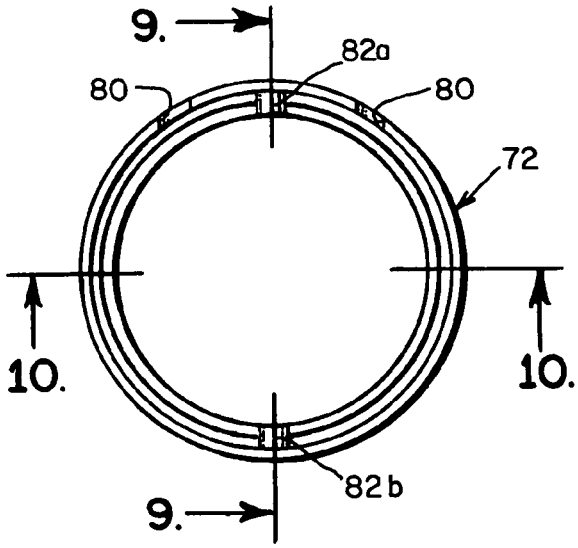
Fig. 8.
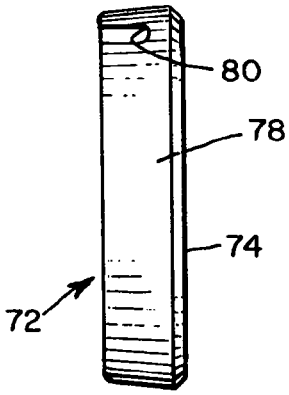
Fig. 7.
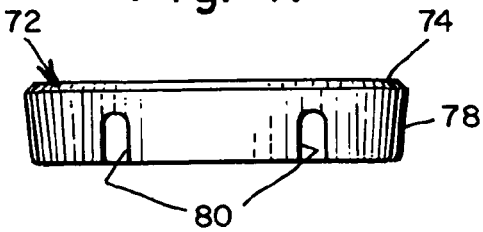
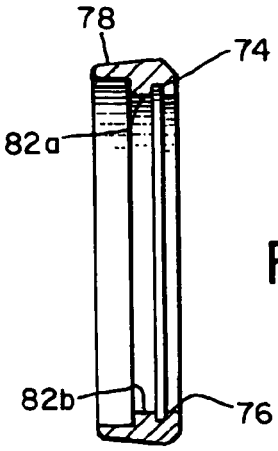
Fig. 9.
Fig. 10.
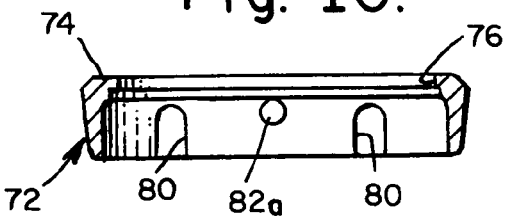

OBJECT-ATTACHING CLIP

BACKGROUND OF THE INVENTION

The present invention relates to clips and, in particular, to improvements in mechanisms and methods for attaching a clip to an object, such as a flashlight.

The art and challenges of attaching objects to supports encompasses a long-established history, and is replete with many solutions. Many times, the solution is often dependent upon the problem presented and, therefore, a specific answer may not satisfactorily or entirely solve the problem. Other times, the problem may be more generalized and thus encompass a broader solution. One specific technique employs the use of a clip attached to an object for holding the object to a support. Here again as just briefly outlined, the clip-holding technique embraces similar considerations. For nonspecific uses, problems can exist in the manner of attaching the clip to the object, e.g., whether the attachment is to be permanent or detachable, or usable for a long-lasting or disposable item or, conversely, for an expensive or inexpensive item. For the former, the cost of the item may not be a consideration while for the latter, cost may be critical.

One item or object of particular interest with respect to the present invention relates to flashlights, particularly hand held flashlights such as, for example, shown in U.S. Pat. Nos. 5,642,932, 6,547,415 and 6,712,485, each assigned to the assignee of the present invention and incorporated herein by reference. In any hand held flashlight, the position of the clip and its orientation with respect to the switch and the light-emitting head are considerations which should be addressed for protecting the light-emitting head while avoiding inadvertent activation of the switch when the flashlight is clipped to a user's belt.

A further consideration is the mechanism by which the clip is attached to the flashlight or other object. Conventional mechanisms may permanently secure the two together, precluding the ability of removing the clip from or reattaching it to the object. While a permanent securement may prevent rotational and longitudinal movement between the clip and the object, such non-rotating and non-longitudinal movement is also desirable when there is a nonpermanent securement.

SUMMARY OF THE INVENTION

Briefly, a clip according to the present invention enables an object, such as a flashlight, to be held onto a support, such as a belt. The object body, such as a flashlight barrel, has an extended surface along which an elongated portion of the clip extends. A body-holding portion holds the clip to the body and defines an object-to-support holding site. A retainer member associated with the body-holding portion of the clip secures it to the body. Cooperating protuberances and dimples on the retainer and the body hold it in place against rotational and longitudinal displacement on the body. For a flashlight, where its switch and light-emitting head are placed at opposed ends of the flashlight barrel, the clip is preferably orientated on the flashlight that its elongated portion extends towards the light-emitting head and away from the switch. This orientation protects the light emitting head while avoiding accidental manipulation of the switch, especially if configured as a push-button switch.

Other aims and advantages, as well as a more complete understanding of the present invention, will appear from the following explanation of exemplary embodiments and the accompanying drawings thereof.

BRIEF DESCRIPTION OF THE DRAWINGS

FIG. 1 is a top view of a flashlight equipped with a preferred embodiment of a clip according to the present invention;

FIG. 1*a* is cross-sectional view of the exemplified flashlight depicted in FIG. 1 taken along line 1*a*-1*a* thereof (in increased scale);

FIGS. 1*b* and 1*c* are views of a portion of the mid-section body or barrel of the flashlight shown in FIG. 1 for illustrating its respective groove-separating lands (same scale as in FIG. 1);

FIG. 1*d* is a cross-sectional view of the portion of the mid-section body or barrel of FIG. 1*b* taken along line 1*d*-1*d* of FIG. 1*b;*

FIGS. 3, 4 and 5 are top, rear end and side views, respectively, of a clip used in the exemplified flashlight illustrated in FIGS. 1 and 2;

FIGS. 6, 7 and 8 are respectively a front end view and two side views, taken orthogonally with respect to one another, of a retainer for retaining the clip shown in FIGS. 3-5 onto the exemplified flashlight depicted in FIGS. 1 and 2;

FIGS. 9 and 10 are cross-sectional views of the retainer illustrated in FIG. 6 taken respectively along lines 9-9 and 10-10 thereof;

FIGS. 11, 12 and 13 are respectively a top view and two side views, taken orthogonally with respect to one another, of a cover for the clip shown in FIGS. 3-5;

FIG. 14 is a cross-sectional view of the clip cover illustrated in FIG. 13 taken along line 14-14 thereof; and FIG. 15 is a fragmentary side view of the flashlight secured to a support by the clip.

DETAILED DESCRIPTION OF THE PREFERRED EMBODIMENTS

Figure 2:
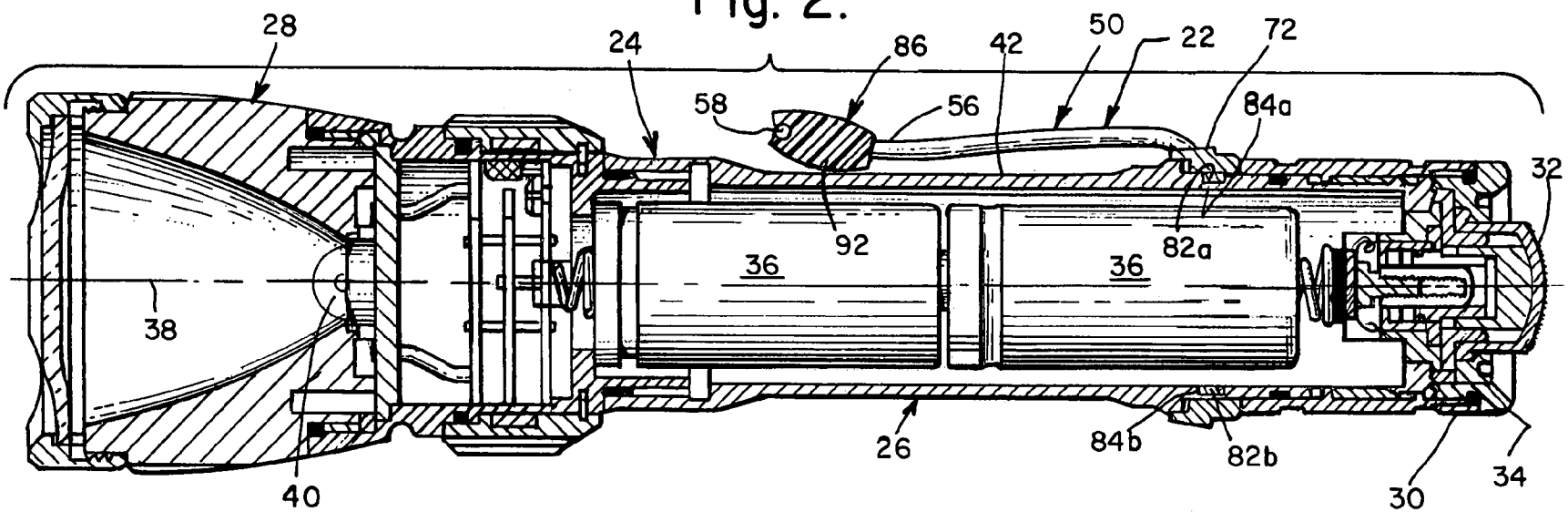
FIG. 2 is cross-sectional view of the exemplified flashlight depicted in FIG. 1 taken along line 2-2 thereof.

As shown in FIGS. 1, 1*a*-1*d* and 2, a combination or assembly 20 of an object 24 and a clip 22 is directed to attachment of the object to a support, e.g., a belt 23 (see FIG. 15). In the preferred embodiment of the present invention, object 24 is pictured as a flashlight. The flashlight may take any configuration as is known in the art as being capable for use in the present invention. Thus, the present invention may be employed with such hand held flashlights with rear cap pushbutton switch of the types shown, for example, in the above-mentioned U.S. Pat. Nos. 5,642,932, 6,547,415 and 6,712,485 incorporated herein by reference. Nonetheless, it is to be understood that other flashlights may be used in combination with the apparatus disclosed herein and, accordingly, the illustrated flashlight represents an example of an advanced flashlight desired by the type of person who would most likely use the apparatus and similar apparatus that would fall within the scope of the invention.

Accordingly, flashlight 24 includes a generally cylindrically-shaped mid-section body or barrel 26 bounded by a front end or light-emitting head 28 and a tail end 30. A switch mechanism 32 is located at its tail end, and retained there by a rear cap 34. The flashlight body or battery housing 26 is adapted to house at least one battery 36 and lies along a longitudinally-extending axis 38. A lamp assembly 40 is housed in front end 28 and is electrically coupled to the battery and switch 32 for enabling flashlight performance.

Assembly 40 may be a tungsten bulb or an LED, preferably a high intensity LED. Switch or switching mechanism 32 may be an on/off type wherein one depression of its push button completes an electric circuit, which causes batteries 36 to energize the lamp in lamp assembly 40, and a successive depression opens the circuit to de-energize the lamp. Alternately, mechanism 32 may operate to illuminate the lamp when the push button is depressed and/or a double activation switch as previously described.

An elongated portion of mid-section body 26 defines a surface 42 which is disposed to cooperate with clip 22 to enable the attachment or clipping-on of object or flashlight 24 to a support, such as a belt worn by a user. Body 26 further includes a groove construction, defined by two curved oppositely positioned grooves 44 (FIGS. 1*a*-1*d*). The grooves 44 each have a preferably arcuate configuration concentric about axis 38 and preferably describe equal arcs, and are located adjacent rear cap 34 and closely placed by the beginning portion of surface 42.

Two diametrically opposed lands 46*a* and 46*b* are positioned opposite one another on elongated body 26 and between the respective ends of the two arcuate grooves 44.

Clip 22, as more fully depicted in FIGS. 3-5, is formed from a resilient wire of preferably generally circular cross-section (for example, 0.07 diameter stainless steel wire) and includes an elongated portion 50 extending along and adjacent body surface 42 and an open-ended body-holding portion 52 at one end of portion 50. Being made of a resilient wire, the body-holding portion 52 acts as a spring-biasable structure holding or gripping the clip to the body in a grippingly holding relationship. The disposition of elongated portion 50 with respect to body surface 42 defines an object-to-support holding site.

Elongated portion 50 has a generally U-shaped configuration defined by a pair of arms 56 joined together at a first of their ends at a U-shaped terminus 58, whose entry 59 is slightly crimped, so that the crimped entry has a slightly smaller dimension than that of the "U" of U-shaped terminus 58. The pair of arms 56 extend outwardly from terminus 58 to a pair of second ends 60.

Body-holding portion 52 comprises a groove-bracketing part 62 (as best shown in FIG. 4) which is defined by two curved prongs 64, preferably arcuate, that are configured to embrace or bracket grooves 44. Prongs 64 terminate in spaced-apart ends 66.

A juncture 68 (see FIG. 5) joins double-pronged part 62 to second ends 60 of arms 56 to form a generally orthogonal configuration with its joined parts. Juncture 68 includes a segment 70, for each of the prongs 64, which two segments extend generally at right angles to axis 38 and couple prongs 64 to second ends 60. The space between segments 70 (i.e. second ends 60) and the space between prong ends 66 are preferably such that the two preferably equally dimensioned prongs 62 together extend about an arc greater than 180°.

The relationship between lands 46*a* and 46*b* and curved prongs 64 of clip body-holding portion 52 provides positioning of the clip on flashlight body 26. Specifically, the lands are sized with respect to the prongs 64 for enabling the land 46*a* to fit between the curved prongs 62 at juncture 68, and the land 46*b* to fit between the curved prongs 64 at their ends 66. The position of the lands 46*a* and *b* fix the positioning of clip elongated portion 50 with respect to elongated body surface 42, while also acting as impediments to rotation of clip 22 with respect to flashlight body 26.

As illustrated in FIGS. 1, 1*a*, 2 and 6-10, a retainer 72 (preferably fabricated of a plastic material and slightly flexible) is placed about prongs 64 of body-holding portion 52 and grooves 44 (when the prongs reside therein) to ensure that the prongs are held within the grooves. As detailed in FIGS. 6-10, retainer 72 is configured as an annular member having a base 74 with an opening 76 therein and an annular collar 78. Two spaced apart notches or cut-away openings 80 are formed in collar 78 into which the wire of clip 22 at angled juncture 68 extends and which form an egress for the wire. Two diametrically opposed protuberances 82*a* and 82*b* facing one another are formed on the interior of collar 78 and are disposed to respectively engage two likewise diametrically opposed holes or dimples 84*a* and 84*b* (see FIGS. 1*b*, 1*c* and 2) in lands 46*a* and 46*b* of flashlight body 26 when the retainer 72 is placed onto the body with its cut-away openings 80 receiving the wire clip 22 generally at angled juncture 68. When the protuberances 82*a* and 82*b* are so received by the dimples 84*a* and 84*b*, the annular retainer 72 holds the prongs 64 within the grooves 44 against rotational and longitudinal movement, while the retainer's collar 78 prevents the prongs 64 from radially escaping the grooves 44.

Alternatively, the protuberances 82*a* and 82*b* may be carried by the flashlight body 26 and the dimples 84*a* and 84*b* may be carried by the retainer 72. In such case, the protuberances 82*a, b* and the dimples 84*a, b* shown in FIG. 1*a* would be substituted for one another.

As best viewed in FIGS. 1, 2 and 11-14, a cover 86 is secured to U-shaped part 54 of the clip within U-shaped terminus 58 (see also FIG. 3). The cover has a generally wheel-shaped configuration with a recess 88 placed about a substantial part of its periphery for reception of U-shaped terminus 58 therein. The diameter of the wire at the U-shaped terminus and its crimped entry 59 (as depicted in FIG. 3) establishes a firm engagement therebetween and a secure retention of cover 86 within terminus 58. The cover also provides a face 90 on which an inscription may be placed and a second face 92 which is disposed to extend towards and preferably into contact with extended surface 42, as biased by the resiliency of the wire.

When the flashlight 24 is secured by the clip 22 to a belt 23 (shown in cross-section in FIG. 15) worn by a user, the belt 23 will be disposed between the flashlight's extended surface 42 and the clip's arms 56. The cover's second face 92 may bear against the inner surface of the worn belt, or the cover 86 may protrude beneath the lower edge of the belt, for securing the flashlight 24 to the worn belt.

Although the invention has been described with respect to particular embodiments thereof, it should be realized that various changes and modifications may be made therein without departing from the spirit and scope of the invention.

What is claimed is:

1. Apparatus for enabling an object to be held onto a support, comprising:

a body associated with the object having an extended surface, said body including a groove construction having a substantially arcuate configuration and a land; a clip having an elongated portion extending adjacent said extended surface and a spring-biasable body-holding portion grippingly holding said clip to said body in a grippingly holding relationship for enabling the adjacency of said elongated portion with respect to said extended surface to define an object-to-support holding site, said body-holding portion comprising two curved prongs embracing said groove construction with said land between said curved prongs; and a retainer associated with said body-holding portion of said clip for retaining said body-holding portion in the grippingly holding relationship with said body.

2. The apparatus according to claim 1 in which said clip body-holding portion comprises a wire at least partially encircling said groove construction.

3. The apparatus according to claim 1 in which said groove construction comprises two opposed grooves.

4. The apparatus according to claim 1 in which said object comprises a flashlight having a light-emitting head and a switching mechanism, in which said grooves are positioned adjacent said switching mechanism end and said clip is positioned such that said elongated portion extends towards said light-emitting head.

5. The apparatus according to claim 1 in which said switching mechanism is disposed at an end opposite to that of said light-emitting head.

6. The apparatus according to claim 1, wherein:

the object comprises a flashlight.

7. Apparatus for enabling an object to be held onto a support, comprising:

a body associated with the object having an extended surface, said body including two opposed grooves and dimples adjacent said grooves; a clip having an elongated portion extending adjacent said extended surface and a spring-biasable body-holding portion grippingly holding said clip to said body in a grippingly holding relationship for enabling the adjacency of said elongated portion with respect to said extended surface to define an object-to-support holding site, said body-holding portion comprising a wire configured as a bracketing double-pronged part formed from two prongs, said bracketing double-pronged part extending generally orthogonally with respect to said elongated portion at an angled juncture; and a retainer associated with said body-holding portion of said clip for retaining said body-holding portion in the grippingly holding relationship with said body, said retainer including an annular member surrounding said body at said grooves and covering said bracketing double-pronged part, said annular member including a collar, two cut-away openings in said collar through which said wire at said angled juncture extends, said retainer thereby securing said body-holding portion to said body, and two protuberances diametrically opposed to and extending towards one another and respectively into said dimples for preventing rotational and longitudinal movement of said retainer with respect to said body.

8. The apparatus according to claim 7 further including two lands positioned opposite from one another on said body, and in which said grooves have ends facing one another and located respectively between and separated by said lands, and said dimples are located respectively in said lands.

9. The apparatus according to claim 7 in which said annular member includes a base having an opening therein, and said collar extends from said base.

10. The apparatus according to claim 7, wherein:

the object comprises a flashlight.

11. The apparatus according to claim 7 in which said object comprises a flashlight having a light-emitting head and a switching mechanism disposed at opposed ends thereof, in which said groove construction is positioned adjacent said switching mechanism end and said clip is positioned such that its elongated portion extends towards said light-emitting head.

12. Apparatus for enabling an object to be held onto a support, comprising: a body associated with the object having an extended surface, said body including two opposed grooves having ends facing one another, said body including first and second lands positioned opposite from one another between said ends of said grooves; a clip having an elongated portion extending adjacent said extended surface and a spring-biasable body-holding portion grippingly holding said clip to said body in a grippingly holding relationship for enabling the adjacency of said elongated portion with respect to said extended surface to define an object-to-support holding site, said body-holding portion comprising a wire at least partially disposed in said grooves; and a retainer associated with said body-holding portion of said clip for retaining said body-holding portion in the grippingly holding relationship with said body.

13. The apparatus according to claim 12 wherein:

said body-holding portion comprises two curved prongs having a coupling at a first of their ends to said elongated portion and a termination at a second of their ends that are spaced apart from one another, and said curved prongs at their first ends are spaced apart from one another; and said first land is sized for enabling said first land to fit between said curved prongs at their first ends, and said second land is sized for enabling said second land to fit between said curved prongs at their second ends.

14. The apparatus according to claim 12, wherein:

the object comprises a flashlight.

15. Apparatus for enabling an object to be held onto a support, comprising: a body associated with the object having an extended surface, said body including a groove construction having a substantially arcuate configuration; a clip having an elongated portion extending adjacent said extended surface and a spring-biasable body-holding portion grippingly holding said clip to said body in a grippingly holding relationship for enabling the adjacency of said elongated portion with respect to said extended surface to define an object-to-support holding site, said elongated portion comprising a generally U-shaped part having a pair of arms joined together at a first of their ends at a U-shaped terminus and extending outwardly therefrom to a pair of second ends, said body-holding portion comprising a resilient wire configured with a pair of curved prongs disposed to embrace said groove construction and a juncture generally orthogonally joining said prongs to said U-shaped part second ends and a retainer associated with said body-holding portion of said clip for retaining said body-holding portion in the grippingly holding relationship with said body.

16. The apparatus according to claim 15 in which said clip elongated portion comprises a resilient wire having said generally U-shaped terminus.

17. The apparatus according to claim 16 further including a cover secured to said clip at said U-shaped terminus.

18. The apparatus according to claim 17 in which said cover includes a part extending towards and into contact with said extended surface, as biased by the resiliency of said wire of said elongated portion.

19. The apparatus according to claim 15 in which said object comprises a flashlight having a light-emitting head and a switching mechanism disposed at opposed ends thereof, in which said groove construction is positioned adjacent said switching mechanism end and said clip is positioned such that its elongated portion extends towards said light-emitting head.

20. The apparatus according to claim 15 in which said object comprises a flashlight.

21. Apparatus for enabling an object to be held onto a support, comprising:

a body associated with the object having an extended surface, said body including two opposed grooves; a clip having an elongated portion extending adjacent said extended surface and a spring-biasable body-holding portion grippingly holding said clip to said body in a grippingly holding relationship for enabling the adjacency of said elongated portion with respect to said extended surface to define an object-to-support holding site, said body-holding portion including a bracketing double-pronged part formed from two prongs, said bracketing double-pronged part extending generally orthogonally with respect to said elongated portion at an angled juncture; a retainer associated with said body-holding portion of said clip for retaining said body-holding portion in the grippingly holding relationship with said body, said retainer including an annular member surrounding said body at said grooves and covering said bracketing double-pronged part, said annular member including two cut-away openings through which said wire at said angled juncture extends; and one of said body and said annular member including two dimples and the other of said body and said annular member including two protuberances, said dimples diametrically situated with respect to one another and respectively receiving said protuberances for preventing rotational and longitudinal movement of said retainer with respect to said body.

22. The apparatus according to claim 21, wherein:

said body includes said dimples and said annular member includes said protuberances.

23. The apparatus according to claim 22, wherein:

said grooves are arcuate grooves, said body includes two lands respectively between the ends of said grooves, and said dimples are respectively situated in said lands.

24. The apparatus according to claim 21, wherein:

the object comprises a flashlight.

25. In a flashlight having a clip for enabling the flashlight to be held onto a support, in which the flashlight comprises a generally cylindrically-shaped elongated body disposed along a longitudinally-extending axis and housing at least one battery and having a light-emitting head and a switching mechanism disposed at opposed ends thereof, the improvement comprising: an extended surface on the elongated body disposed generally parallel to the axis; two generally arcuately formed grooves positioned opposite to one another in the elongated body between the switching mechanism and said extended surface, and disposed generally perpendicularly to the axis, said grooves having ends facing one another; said clip including a resilient wire having an elongated portion extending adjacent said extended surface, a body-holding portion holding said clip to said body and defining a flashlight-to-support holding site, and an angled juncture joining said elongated portion and said body-holding portion, in which said elongated portion has a generally U-shaped configuration and extends towards the light-emitting head end and away from the switching mechanism end, and said body-holding portion comprises a bracketing double-pronged part formed from curved prongs, said bracketing double-pronged part extending generally orthogonally with respect to said elongated portion at an angled juncture, said curved prongs having a coupling at a first of their ends to said elongated portion and a termination at a second of their ends that are spaced apart from one another, and said curved prongs at their first ends are spaced from one another; first and second lands positioned opposite one another on said elongated body and between said grooves, said first land sized for enabling said first land to fit between said curved prongs at their first ends, and said second land sized for enabling said second land to fit between said curved prongs at their second ends; diametrically placed dimples located respectively in said lands; and a retainer including a substantially annular member surrounding said flashlight body at said grooves and covering said bracketing double-pronged part, said annular member including two cut-away openings through which said wire at said angled juncture extends, and two protuberances respectively received by said dimples.

26. Flashlight apparatus comprising in combination:

a flashlight including a battery housing;

two arcuate grooves in said battery housing;

a clip including a substantially U-shaped wire having ends configured with two arcuate prongs respectively received by said grooves;

a retainer including an annular member encircling said housing at said grooves for retaining said prongs in said grooves, said annular member having two cut-away openings through which said substantially U-shaped wire extends in the vicinity of said prongs; and one of said housing and said annular member including two dimples and the other of said housing and said annular member including two protuberances, said dimples arcuately spaced from one another and respectively receiving said protuberances for preventing rotational and longitudinal movement of said annular member with respect to said housing.

27. Flashlight apparatus according to claim 26, wherein:

said housing includes said dimples and said annular member includes said protuberances.

28. Flashlight apparatus according to claim 27, wherein:

said housing includes two lands respectively between the ends of said grooves, and said dimples are respectively situated in said lands.

29. Flashlight apparatus comprising in combination:

a flashlight including a battery housing;

two arcuate grooves in said battery housing;

a clip including a substantially U-shaped wire having ends configured with two arcuate prongs respectively received by said grooves;

a retainer including an annular member encircling said housing at said grooves for retaining said prongs in said grooves; and one of said housing and said annular member including two dimples and the other of said housing and said annular member including two protuberances, said dimples arcuately spaced from one another and respectively receiving said protuberances for preventing rotational and longitudinal movement of said annular member with respect to said housing.

30. Flashlight apparatus comprising in combination:

a flashlight including a battery housing;

a substantially arcuate groove construction in said battery housing;

a clip including a substantially U-shaped wire having curved ends embracing said groove construction;

a retainer including an annular member encircling said housing at said groove construction for retaining said curved ends, and one of said housing and said annular member including at least one dimple and the other of said housing and said annular member including at least one protuberance, said at least one dimple receiving said at least one protuberance for preventing rotational and longitudinal movement of said annular member with respect to said housing.

31. Flashlight apparatus according to claim 30, wherein:

said annular member includes at least one opening through which said substantially U-shaped wire extends in the vicinity of said curved ends.

32. Flashlight apparatus according to claim 30, wherein:

said at least one dimple comprises two dimples and said at least one protuberance comprises two protuberances, said dimples arcuately spaced from one another and respectively receiving said protuberances.

33. Apparatus for enabling an object to be held onto a support, comprising:

a body associated with the object having an extended surface, said body including two opposed grooves; a clip having an elongated portion extending adjacent said extended surface and a spring-biasable body-holding portion grippingly holding said clip to said body in a grippingly holding relationship for enabling the adjacency of said elongated portion with respect to said extended surface to define an object-to-support holding site, said body-holding portion comprising a wire configured with two prongs; and a retainer associated with said body-holding portion of said clip for retaining said body-holding portion in the grippingly holding relationship with said body, said retainer including an annular member surrounding said body at said grooves and covering said prongs, said annular member including a collar and at least one opening in said collar through which said wire extends.

34. The apparatus according to claim 33, wherein:

one of said body and said annular member includes a dimple and the other of said body and said annular member includes a protuberance extending into said dimple for preventing rotational and longitudinal movement of said retainer with respect to said body.

35. The apparatus according to claim 33, wherein:

the object comprises a flashlight.

36. Apparatus for enabling an object to be held onto a support, comprising:

a body associated with the object having an extended surface, said body including a groove construction having a substantially arcuate configuration; a clip having an elongated portion extending adjacent said extended surface and a spring-biasable body-holding portion grippingly holding said clip to said body in a grippingly holding relationship for enabling the adjacency of said elongated portion with respect to said extended surface to define an object-to-support holding site, said body-holding portion comprising a groove-bracketing part including two curved prongs disposed to embrace said groove construction; and a retainer associated with said body-holding portion of said clip for retaining said body-holding portion in the grippingly holding relationship with said body.

37. The apparatus according to claim 36, wherein:

the object comprises a flashlight.

* * * * *

UNITED STATES PATENT AND TRADEMARK OFFICE

CERTIFICATE OF CORRECTION

PATENT NO. : 7,278,764 B2
APPLICATION NO. : 11/031756
DATED : October 9, 2007
INVENTOR(S) : Paul Y. Kim It is certified that error appears in the above-identified patent and that said Letters Patent is hereby corrected as shown below:

At column 5, line 12, “claim 1” should be --claim 4--.

Signed and Sealed this

Eighteenth Day of December, 2007

JON W. DUDAS
*Director of the United States Patent and Trademark Office*